United States Patent [19]

Haygarth

[11] Patent Number: 4,671,824

[45] Date of Patent: Jun. 9, 1987

[54] PROCESSES FOR PRODUCING IMPROVED WEAR RESISTANT COATINGS ON ZIRCONIUM SHAPES

[75] Inventor: John C. Haygarth, Corvallis, Oreg.

[73] Assignee: Teledyne Industries, Inc., Albany, Oreg.

[21] Appl. No.: 810,098

[22] Filed: Dec. 18, 1985

Related U.S. Application Data

[63] Continuation of Ser. No. 596,583, Apr. 6, 1984, abandoned.

[51] Int. Cl.[4] ..... C23C 22/70

[52] U.S. Cl. ..... 148/6.11; 148/6.20

[58] Field of Search ..... 148/6.11, 20

[56] References Cited

U.S. PATENT DOCUMENTS 2,987,352 6/1961 Watson ..... 148/6.14 R

FOREIGN PATENT DOCUMENTS 37-16823 10/1962 Japan ..... 148/6.11

OTHER PUBLICATIONS

Anderson, "Electrochemical Technology", 1966, vol. 4, No. 3–4, pp. 157–162.

*Primary Examiner*—Sam Silverberg

*Attorney, Agent, or Firm*—Shoemaker and Mattare, Ltd.

[57] ABSTRACT

Process for producing zirconium oxide blue-black coatings on zirconium alloy substrates by treating said alloys with molten salts containing small amounts of oxidizing compounds. The molten salts are sodium cyanide and combinations of sodium chloride and potassium chloride.

6 Claims, No Drawings

PROCESSES FOR PRODUCING IMPROVED WEAR RESISTANT COATINGS ON ZIRCONIUM SHAPES

This is a continuation of application Ser. No. 596,583, filed Apr. 6, 1984, now abandoned.

BACKGROUND OF THE INVENTION

1. Field of the Invention

This invention relates to new methods of producing wear resistant oxide coatings on zirconium metal alloy shapes which will exhibit improved wear resistance. Specifically, it deals with new processes for producing improved blue-black oxide coatings on zirconium alloy shapes for producing bearings, valves or like products which are subject to wear under unusual conditions, including corrosive conditions.

2. Description of the Prior Art

The excellent resistance of zirconium to corrosion by hot water has been known for many years and was among the factors influencing its adoption as the fuel-cladding material in boiling-water and pressurized-water nuclear power reactors. Zirconium also displays excellent corrosion-resistance in many aqueous and nonaqueous media and for this reason is enjoying increasing use in the chemical process industry. A limitation to the wider application of zirconium in this area is its relatively low resistance to abrasion and its tendency to gall, a result of its relatively low hardness of about 190 BHN (200 kg $mm^{-2}$) as normally used.

In the prior art, attempts have been made to produce zirconium oxide coatings on zirconium shapes for the purpose of increasing their abrasion resistance. One of these processes is that disclosed in the Watson U.S. Pat. No. 3,615,885 which discloses a procedure for developing thick (up to 0.23 mm) oxide layers on Zircaloy 2 and Zircaloy 4. However, this procedure results in significant dimensional changes especially for parts of thickness below about 5 mm, and the oxide film produced does not exhibit especially high abrasion resistance.

Another patent which discloses a method of producing a blue-black oxide coating on zirconium alloy shapes for the purpose of increasing their abrasion resistance is U.S. Pat. No. 2,987,352. Both this patent and the above-mentioned patent produce a zirconium dioxide coating on zirconium alloys by means of air oxidation. The first mentioned patent continues the air oxidation long enough to produce a beige coating of greater thickness than the blue-black coating of the latter patent. This beige coating does not have the wear resistance of the blue-black coating and thus is not applicable to parts such as bearings, sliding fittings and valves where there are two work faces in close proximity. Since the coating wears down more quickly than the blue-black oxide coating, the close tolerances are lost and the part becomes useless.

With the blue-black oxide coatings, the thickness is considerably less and the hardness of the coating is considerably greater. This type of coating lends itself to such services as mentioned above. Although the blue-black coating is a more abrasion resistant coating than the beige coating, it is a relatively thin coating. It is, therefore, desirable to produce blue-black coatings of increased abrasion resistance without producing the beige-type coatings of the prior art.

BRIEF SUMMARY OF THE INVENTION

Objects of the Invention

It is, accordingly, one object of the present invention to provide a new process for producing zirconium dioxide blue-black coatings on zirconium alloy shapes.

Another object of the present invention is to produce zirconium oxide coatings on zirconium alloys which are corrosion resistant and have increased wear resistance and gall resistance.

It is the further object of the present invention to provide new processes for producing zirconium oxide coatings on zirconium alloys, said coatings having greater wear resistance than those of prior processes.

Advantages of the present invention will become apparent from the following detailed descriptions and examples.

In accordance with the above objects, it has been found that zirconium dioxide coatings of increased thickness and abrasion resistance can be produced on zirconium alloys by oxidizing said alloys in certain molten salts containing small amount of oxidizing compounds.

More specifically, it was found that shapes made from zirconium alloys could be oxidized to produce blue-black oxide coatings thereon which have enhanced abrasion resistance over those produced by air oxidation by treating these alloys in a molten bath of sodium chloride and potassium chloride to which sodium carbonate has been added or by treating these alloys in molten sodium cyanide containing small amounts of oxidizing materials.

DESCRIPTION OF THE PREFERRED EMBODIMENTS

As stated above, it has been found that more wear resistant gall resistant zirconium oxide coatings can be produced on zirconium alloys substrates by treating these substrates with molten salts containing oxidizing compounds.

By oxidizing compounds is meant oxygen bearing compounds which when present in sufficient amounts in the molten salt are capable of oxidizing the zirconium alloy surface to zirconium dioxide. These oxygen bearing compounds must be dissolvable in the molten salts. One such compound is sodium carbonate, however, other compounds having the above criteria can be used. These oxidizing compounds are present in the molten salts in at least about 0.1 to 1% by weight but can be present in greater amounts as desired.

The molten salts used for treating the alloys can be chlorides, nitrates, cyanides and the like. For purposes of illustrating the present invention, a combination of sodium chloride and potassium chloride or molten sodium cyanide alone have been used. However, as stated above, many other salts are capable of being used in the process of the instant invention. In the following examples, equimolar mixtures of sodium chloride and potassium chloride were used because at that ratio the melting temperature was at its lowest, which is around 600° C. In this particular situation, sodium carbonate was added as the oxidizing compound in amounts up to 5%. This addition also lowers the melting temperature of the salt. It is possible, however, if one were to use temperatures as high as 800° C., one could use pure sodium chloride and not require any potassium chloride in the molten salt bath.

The sodium cyanide is heated to molten which again will be adjusted by the addition of oxidizing compounds, however, the temperature will be at least about 550° C.

The rate of oxidation is directly proportionate to the increase in temperature.

It has also been found that the corrosion resistance for the treated products is maintained at the high level zirconium alloys normally have even after treatment for increased abrasion resistance.

It has also been found as a result of testing for corrosion resistance that in some instances this resistance has increased as a result of exposure to acid. Tests have been made with boiling 70% nitric acid, boiling 20% hydrochloric acid and boiling 60% sulfuric acid for 96 hours, and the corrosion resistance has subsequently remained intact and in the case of the nitric acid showed a slight enhancement.

Some specific examples and tests showing comparative results of the present process and prior art process are set forth below.

The alloys Zircadyne 702, zircaloy 2 and zircaloy 4 were tested for abrasion resistance after oxidation treatment. The corrosion of these alloys is given in the following Table I.

TABLE I

| | Alloy composition, w % | | |
|---|---|---|---|
| | Zircadyne 702 | Zircaloy 2 | Zircaloy 4 |
| Zr, min | 99.2 | 97.5 | 97.5 |
| Hf | <0.02* | <0.01 | <0.01 |
| Sn | — | 1.2–1.7 | 1.2–1.7 |
| Fe | 0.2 max | 0.07–0.20 | 0.18–0.24 |
| Cr | | 0.05–0.15 | 0.07–0.13 |
| Ni | — | 0.03–0.08 | — |
| H, max | 0.005 | 0.005 | 0.005 |
| N, max | 0.025 | 0.025 | 0.025 |
| C, max | 0.05 | 0.05 | 0.05 |
| 0, typical | 0.16 | 0.12 | 0.12 |

*Up to 4.5 w % Hf permissible for non-nuclear applications

The alloys were obtained in rod form, about 0.29 inches diameter, annealed at 705° C. for two hours. The rod was centerless ground to 0.249+0.000−0.001 inches diameter, with a finish of 20 microinches RMS. The rod was cut into lengths of 2.0 inches, and the diameter of each piece machined to 0.125 inches for a length of 0.125 inches from each end to provide stubs with which to hold the rods in the abrasion test frame. The rods thus had a cylindrical surface with a 20 microinch finish, the length of which was 1.75 inches and the diameter of which was 0.248 to 0.249 inches.

The rods were degreased in trichloroethane and dried. They were pickled by immersion with agitation in an acid mixture, comprising 37 volume % of 70% nitric acid, 3 volume % of 49% hydrofluoric acid, the balance water, at 38°–46° C. for one to two minutes, then washed for five minutes in running tap water, then rinsed in distilled water, then in ethyl alcohol, then air dried. Thereafter, they were handled only with cotton gloves.

Rods were oxidized in air at temperatures from 600° C. to 800° C. in a horizontal tube furnace, diameter three inches, heated length 24". Air was drawn through the tube at two standard cc/sec. Times of oxidation ranged from 10 minutes to 50 hours. Rods were oxidized in molten salts at temperatures of 600° C. to 800° C. The salt melts were contained in Inconel 600 cans heated by a pot furnace. In all treatments, sample temperatures were controlled to ±10° C.

Abrasion resistance was measured using a slurry-pot tester adapted from the design of W. Tsai, J. A. C. Humphrey, I. Cornet and A. V. Levy, Wear, 68 (1981) 289. In this, two cylindrical specimens are mounted on opposite sides of a frame through the center of which passes a spindle. The specimen axes are parallel to the spindle axis and equidistant from it. The whole is immersed in a slurry of an abrasive contained in a baffled vessel. Rotation of the spindle produces motion of the specimens relative to the slurry, and their weight-loss measures the abrasive wear. In this work the specimens were mounted at a radius of 52.4 mm (2.063 inch) from the spindle axis, and the rotation rate was 29.17±0.17 revolutions per second (1750±10 rpm). The abrasive was AFS 50–70 Test Sand, 0.300 mm to 0.212 mm, (50–70 mesh) from Ottowa Silica Co., Box 577, Ottawa, Ill. 61350, as described in ASTM G65-80. It was mixed with water to give a 30 w % (13.9 v %) slurry. A fresh charge of slurry, about 2.9 1, was used for each set of specimens. To avoid errors from excessive abrasion near the ends of the specimens, presumably resulting from turbulence caused by the frame, the ends were protected for a length of 6.35 mm (0.25") from the frame by thin rubber sleeves cut from surgical tubing. Thus the exposed specimen length was 32.0 mm (1.25").

Specimens were exposed to abrasion for total times ranging from 120 seconds to 9000 seconds. At intervals, they were removed from the slurry-pot, water-washed, dried, and weighed with an accuracy of ±0.1 mg. Volume lost was calculated from weight loss by dividing by density. Densities of 7880, 6510 and 5741 kg $m^{-3}$ respectively were used for steel, zirconium alloys and $ZrO_2$. For oxidized specimens, volume removed was calculated as $ZrO_2$, independent of the extent of wear.

Galling resistance was estimated using Schumacher's method. In this the end of a right, circular cylinder is rotated through 360° while pressed with a known load against a flat surface. The contact surfaces are then examined for evidence of galling.

Corrosion resistance was examined by measuring weight-loss of specimens after exposure for 96 hours to boiling 70% and 60% $H_2SO_4$, boiling 70% $HNO_3$, and boiling 20% HCl to which 100 ppm or 500 ppm of $Fe^{3+}$ had been added.

EXAMPLE 1

Zircadyne 702 rods were heated in air for three hours, six hours and 10 hours at 800° C. and for 50 hours at 600° C. Weight gains were as shown in Table II.

TABLE II

| Time/hrs | Temp °C. | Weight Gain mg | Specific Wt-Gain mg/cm² |
|---|---|---|---|
| 3 | 800 | 32.1 | 3.31 |
| 6 | 800 | 38.3 | 3.95 |
| 10 | 800 | 83.8 | 8.48 |
| 50 | 600 | 18.7 | 1.93 |

EXAMPLE 2

Zircaloy 2 rods were heat treated in air at 700° for 10 hours at 800° C. for two hours. Weight-gains were as given in Table III.

TABLE III

| Time/hrs | Temp °C. | Weight Gain mg | Specific Wt-Gain mg/cm$^2$ |
|---|---|---|---|
| 10 | 700 | 84.9 | 8.43 |
| 2 | 800 | 90.1 | 8.89 |

EXAMPLE 3

A zircaloy 4 rod was heat treated in air at 800° for two hours. The weight gain was 104.2 mg and the specific weight-gain was 10.27 mg/cm$^2$.

EXAMPLE 4

Zircadyne 702 rods were oxidized in sodium cyanide exposed to air at 700° C. and 800° C. for three hours and six hours. The weight gains were as shown in Table IV.

TABLE IV

| | Weight Gain | Specific Wt-Gain |
|---|---|---|
| Time/hrs | mg | mg/cm$^2$ |
| 3 | 14.7 | 1.46 |
| 6 | 18.1 | 1.79 |
| 3 | 31.0 | 3.20 |
| 6 | 37.3 | 3.85 |

EXAMPLE 5

Zircadyne 702 rods were treated in molten sodium cyanide under oxygen-free argon at 700° C. and 800° C. for three and six hours. Weight-gains are given in Table V.

TABLE V

| Time/hrs | Temp °C. | Weight Gain mg | Specific Wt-Gain mg/cm$^2$ |
|---|---|---|---|
| 3 | 700 | 12.1 | 1.20 |
| 6 | 700 | 15.1 | 1.50 |
| 3 | 800 | 24.0 | 2.38 |
| 6 | 800 | 29.9 | 3.09 |

EXAMPLE 6

Zircadyne 702 rods were treated in a melt consisting of an equimolar mixture of sodium chloride and potassium chloride to which 5 w % anhydrous sodium carbonate was added. Treatment was for three and six hours at 800°, and the weight-gains were as given in Table VI.

TABLE VI

| Time/hrs | Temp °C. | Weight Gain mg | Specific Wt-Gain mg/cm$^2$ |
|---|---|---|---|
| 3 | 800 | 28.0 | 2.89 |
| 6 | 800 | 39.0 | 4.05 |

The volume loss after 10, 30 and 60 minutes abrasion is given in Table VI for the rods treated as described in examples 1 through 6, and for some rods of untreated Zircadyne 702, 1018 steel and AISI Ol tool steel heat-treated to Rockwell-C 60 hardness.

| | | | TREATMENT | | | | | VOLUME LOSS, mm$^3$ | | |
|---|---|---|---|---|---|---|---|---|---|---|
| ALLOY | OXIDE COLOR | EXAMPLE | Temp °C. | Time Hrs | Mat'l | Environment | Specific Wt. gain mg/cm$^2$ | 10 min | 30 min | 60 min |
| 702 | blue-black | 1 | 600 | 50 | air | — | 1.93 | 0.33 | 1.78 | 10.17 |
| 702 | blue-black | 1 | 800 | 3 | air | — | 3.31 | 0.64 | 1.24 | 2.25 |
| 702 | blue-black | 1 | 800 | 6 | air | — | 3.95 | 0.61 | 1.41 | 2.58 |
| 702 | beige | 1 | 800 | 10 | air | — | 8.48 | 2.93 | 4.81 | 7.37 |
| Zr2 | beige | 2 | 700 | 10 | air | — | 8.43 | 0.96 | 3.33 | 6.78 |
| Zr2 | beige | 2 | 800 | 2 | air | — | 8.89 | 1.20 | 3.97 | 7.37 |
| Zr4 | beige | 3 | 800 | 2 | air | — | 10.27 | 1.62 | 6.25 | 10.83 |
| 702 | blue-black | 4 | 700 | 3 | NaCN | air | 1.46 | 0.16 | 0.47 | 1.32 |
| 702 | blue-black | 4 | 700 | 6 | NaCN | air | 1.79 | 0.16 | 0.45 | 1.17 |
| 702 | blue-black | 4 | 800 | 3 | NaCN | air | 3.20 | 0.35 | 0.75 | 1.45 |
| 702 | blue-black | 4 | 800 | 6 | NaCN | air | 3.85 | 0.35 | 0.85 | 1.6 |
| 702 | blue-black | 5 | 700 | 3 | NaCN | argon | 1.20 | — | 0.54 | 1.05 |
| 702 | blue-black | 5 | 700 | 6 | NaCN | argon | 1.50 | — | 0.56 | 1.10 |
| 702 | blue-black | 5 | 800 | 3 | NaCN | argon | 2.38 | — | 0.71 | 1.43 |
| 702 | blue-black | 5 | 800 | 6 | NaCN | argon | 3.09 | — | 0.71 | 1.55 |
| 702 | blue-black | 6 | 800 | 3 | NaCl—KCl—$Na_2CO_3$ | air | 2.89 | 0.19 | 0.73 | 1.62 |
| 702 | blue-black | 6 | 800 | 6 | NaCl—KCl $Na_2CO_3$ | air | 4.05 | 0.28 | 0.77 | 1.55 |
| 702 | None | — | — | — | — | — | — | 8.56 | 22.52 | 33.55 |
| 1018 steel | None | — | — | — | — | — | — | 4.56 | — | — |
| AISI 01 Steel, RC 60 | None | — | — | — | — | — | — | — | 1.65 | 2.40 |

As can be seen from Table VII, the oxide coatings produced by the molten salt treatment had less volume loss when tested showing that they were more durable than those produced by air oxidation which includes both blue-black oxide coating and beige oxide coating produced by that process.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the mete and bounds of the claims or that form their functional as well as conjointly cooperative equivalents are, therefore, intended to be embraced by those claims.

I claim:

1. The process of producing a zirconium oxide wear resistant coating on a zirconium alloy surface comprising treating said alloy in a molten salt bath heated to a temperature of between 550° and 800° C. containing small amounts of sodium carbonate.

2. The process of claim 1 wherein the molten salt bath is selected from the group consisting of molten sodium cyanide, molten sodium chloride and mixtures of molten sodium chloride and potassium chloride.

3. The process of claim 2 wherein the molten salt is a mixture of potassium chloride and sodium chloride in equimolar amounts.

4. The process of claim 3 wherein the sodium carbonate is present in the molten salt in an amount of 0.1–5% by weight.

5. The process of claim 1 wherein the sodium carbonate is present in the molten salt in an amount of 0.1–1.0% by weight.

6. The process of claim 5 wherein the molten salt bath is heated to a temperature of 800° C.

* * * * *